US006506079B1

(12) United States Patent
Dingenotto et al.

(10) Patent No.: US 6,506,079 B1
(45) Date of Patent: Jan. 14, 2003

(54) MULTI-POLE ANGLE-CONNECTING DEVICE

(75) Inventors: Meinolf Dingenotto, Schloss Holte-Stukenbrock (DE); Jörg Kühle, Welver-Borgeln (DE)

(73) Assignee: Filtec Filtertechnologie fuer die Elektronikindustrie GmbH, Lippstadt (DE)

( * ) Notice: Subject to any disclaimer, the term of this patent is extended or adjusted under 35 U.S.C. 154(b) by 0 days.

(21) Appl. No.: 09/481,817

(22) Filed: Jan. 11, 2000

(30) Foreign Application Priority Data

Jul. 2, 1999 (DE) ..... 299 11 342 U

(51) Int. Cl.[7] ..... H01R 13/66; H01R 33/945; H01R 9/22; H01R 13/73

(52) U.S. Cl. ..... 439/620; 439/941

(58) Field of Search ..... 439/326, 620, 439/941

(56) References Cited

U.S. PATENT DOCUMENTS 5,242,318 A * 9/1993 Plass ..... 439/620

6,165,018 A * 12/2000 Arnett et al. ..... 439/620

* cited by examiner

*Primary Examiner*—Tulsidas Patel
*Assistant Examiner*—Chandrika Prasad
(74) *Attorney, Agent, or Firm*—Laurence A. Greenberg; Werner H. Stemer; Ralph E. Locher

(57) ABSTRACT

A multi-pole angle-connecting device to be soldered onto a printed circuit board includes a planar filter, a continuous signal conductor assigned to each pole and having soldering ends on one side to be soldered to soldering points of the printed circuit board and ends on another side constructed as connector pins or plug-in sockets. In order to ensure that the angle-connecting device can be produced cost-effectively and can be soldered easily onto printed circuit boards, the filter is constructed as a filter plate which has openings through which the angular conductors are led and which rests on a metallic filter holder that is connected to ground and to a collar of the angle-connecting device. The filter holder has corresponding openings for leading through the soldering ends of the angular conductors, but with larger diameters. The planar filter is advantageously supported by a supporting carrier.

26 Claims, 2 Drawing Sheets

MULTI-POLE ANGLE-CONNECTING DEVICE

BACKGROUND OF THE INVENTION

Field of the Invention

The invention relates to a multi-pole angle-connecting device, in particular for soldering onto a printed circuit board, including a planar filter, and a continuous signal conductor assigned to each pole and having ends on one side to be soldered to corresponding soldering points of the printed circuit board and ends on another side constructed as connector pins or plug-in sockets.

Such angle-connecting devices are provided with C or Pi filters having at least one capacitor for the respective signal conductor. The filtering is preferably performed directly in the input of a device connected to the signal conductor, at the plug-in connector, by planar filters. However, they require space, which is only available with difficulty in the angle-connecting devices that can be soldered onto printed circuit boards.

SUMMARY OF THE INVENTION

It is accordingly an object of the invention to provide a multi-pole angle-connecting device, which overcomes the hereinafore-mentioned disadvantages of the heretofore-known devices of this general type, which is produced cost-effectively and which can be soldered easily onto printed circuit boards.

With the foregoing and other objects in view there is provided, in accordance with the invention, a multi-pole angle-connecting device, particularly for soldering onto a printed circuit board, comprising continuous signal conductors each assigned to a pole, the signal conductors having angular conductors with one soldering end to be soldered to corresponding soldering points of a printed circuit board, another end constructed as connector pins or plug-in sockets and a given diameter; a filter plate having openings through which the angular conductors are led; a metallic filter holder on which the filter plate rests, the filter holder connected to ground and having openings for leading through one of the soldering ends of the angular conductors, the openings in the filter holder having diameters larger than the given diameters; and a collar connected to the filter holder.

The planar filter is constructed as a monolithic or planar filter plate. The filter plate has openings, through which the angular conductors of the signal conductors are led and filtering capacitors connected to the respectively led-through signal conductors are provided, at least for some of the signal conductors. Placed onto the filter plate is a metallic filter holder, which is connected to the metal housing of the angle-connecting device and has corresponding openings, that are provided with diameters larger than the diameters of the signal conductors to avoid short-circuits.

In accordance with another feature of the invention, the side of the filter plate facing the printed circuit board is covered by a centering plate, for stabilization. As a result, the planar filter or the filter plate itself is protected against effects of heat during the soldering of the angle-connecting device onto the printed circuit board.

In accordance with a further feature of the invention, the centering plate is formed by a ceramic mass, or alternatively from a plastic having high heat resistance, in particular provided with a fiber reinforcement increasing the mechanical stability of such a plate. Both glass fibers and other fibers, for example carbon fibers or temperature-resistant synthetic fibers, for instance PTFE fibers, are suitable as a fiber reinforcement. Such plates with thicknesses in the range of 0.4 to 0.8 mm are produced with good dimensional stability, for example by the injection-molding technique.

In accordance with an added feature of the invention, there is provided a latching engagement in order to be able to fit the centering plates into the basic body in a secured manner. For this purpose, the basic body and the centering plate have corresponding latching locations, which also lock the fitted-together angle-connecting device.

In accordance with an additional feature of the invention, the metallic filter holder is provided toward the side of the connector pins or plug-in sockets with an angled offset, which extends to such an extent that its plate terminates with the lower edge of the filter. This filter holder has openings for the lead-throughs of the signal conductors, corresponding to the lead-throughs of the filter, which have a diameter of adequate size to avoid short-circuits to ground with respect to the signal conductors. A plastic insert is provided in an intermediate space that is formed by the angled offset between the filter holder and the molding provided with the connector pins or plug-in sockets. The plastic insert is approximately form-lockingly inserted, stabilizes the angled offset and prevents movements of the molding in relation to the filter holder.

In accordance with yet another feature of the invention, at the same time, the centering plate is supported through the use of an elevated, peripheral edge region against the underside of the plate of the filter. Latching hooks which are provided for securing the plate-shaped filter in the filter holder interact with correspondingly constructed and disposed mating latching locations on the plate of the filter.

In accordance with yet a further feature of the invention, in particular for angle-connecting devices, especially if their terminals have to be bent at a subsequent time, the planar filter is protected from mechanical stresses by a supporting carrier. A printed circuit board or a preferably ceramic substrate sheet, which has the same pattern of holes for the connector pins to be led through as the planar filter, is provided as the supporting carrier. This supporting carrier is placed against one side of the planar filter to bear with surface area contact or areally in such a way that the connector pins can be led through the aligned lead-through openings of both the planar filter and of the supporting carrier. The supporting plate advantageously lies on the side of the planar filter that is facing the bending side in the event of subsequent bending of terminals or connector pins.

In accordance with a concomitant feature of the invention, the lead-throughs are metallized, so that the terminals can be securely soldered on the supporting carrier. At the same time, these lead-throughs are constructed in such a way that the contact points of the planar filter are included in being soldered by solder flowing through by capillary action and the planar filter is included and brought into electrical contact by one soldering operation.

Other features which are considered as characteristic for the invention are set forth in the appended claims.

Although the invention is illustrated and described herein as embodied in a multi-pole angle-connecting device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
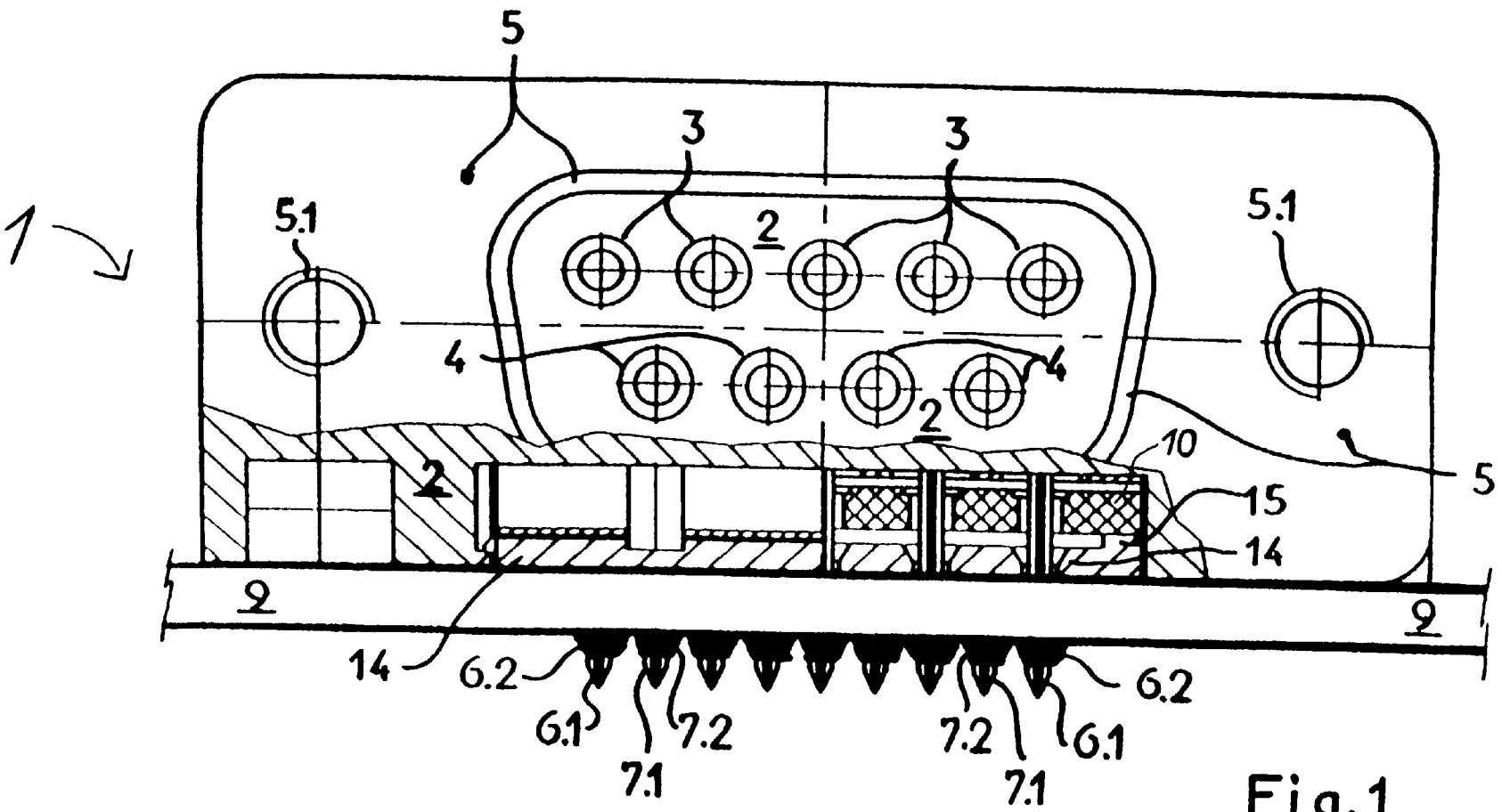
FIG. 1 is a fragmentary, diagrammatic, partly broken-away, elevational view of an angle-connecting device on a printed circuit board.

Referring now to the figures of the drawings in detail and first, particularly, to FIG. 1 thereof, there is seen an angle-connecting device 1 according to the invention, which has been soldered on a printed circuit board 9, that is diagrammatically illustrated and broken away. The angle-connecting device 1 has a basic body 2 which has been surrounded by a collar 5 and placed onto the printed circuit board 9. Soldering ends 6.1 and 7.1 of signal conductors 6.3 and 7.3, which are bent away by 90°, pass through a filter 10, are guided through perforations in the printed circuit board 9 to conductor tracks provided there and are soldered to the latter through respective soldering joints 6.2 and 7.2. On one hand, the collar 5 surrounding the basic body 2 serves for guiding a non-illustrated connector mating piece, which is to be connected to this angle-connecting device. Screw connectors 5.1 are provided for the fastening thereof. On the other hand, the collar 5 establises a connection of a ground connection that is important for trouble-free operation. For this purpose, the collar 5 is constructed as a metallic body, which is connected to a non-illustrated general ground of the printed circuit board 9. The angle-connecting device which is constructed in this way can be easily and unproblematically placed onto the printed circuit board and connected to thus provided soldering joints of the conductor tracks on the printed circuit board 9 through the respective soldering points 6.2 and 7.2.

Figure 2:
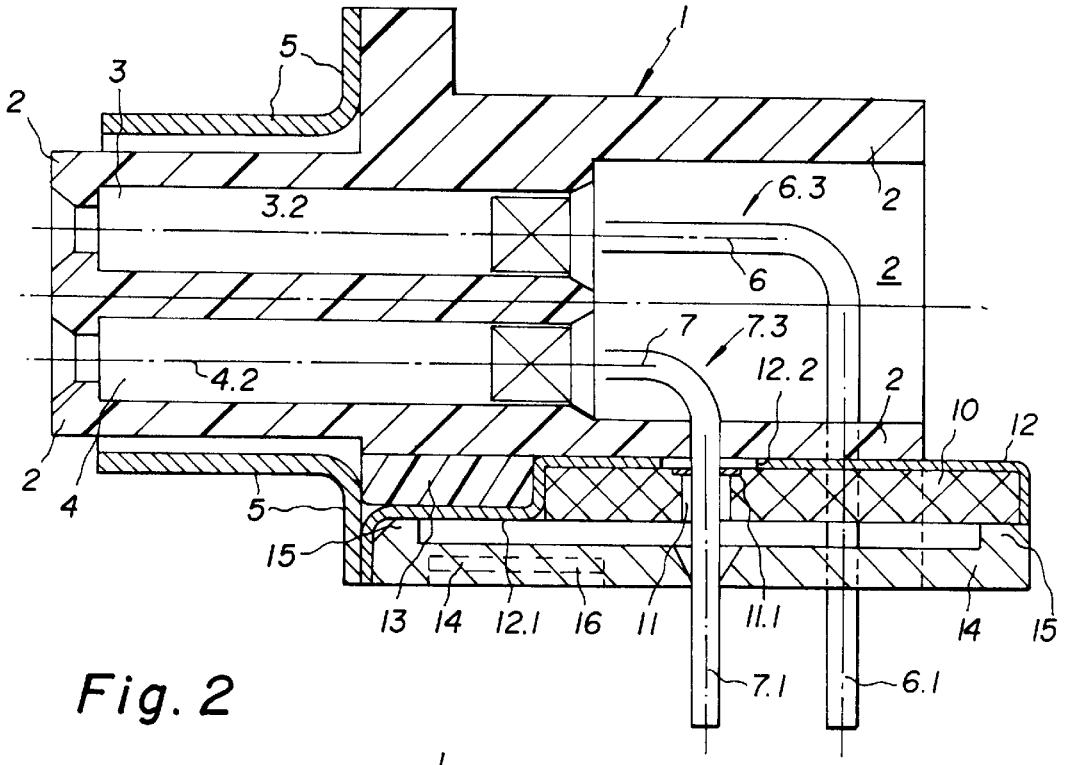
FIG. 2 is a cross-sectional view of an angle-connecting device.

FIG. 2 shows a cross section t rough such an angle-connecting device 1. The basic body 2, which is produced as a molding of plastic, receives contact elements that are represented herein as plug-in sockets 3 and 4. As shown in FIG. 1, the plug-in sockets 3 and are disposed in respective horizontal rows 3.1 and 4.1. As seen in FIG. 2, the rows extend along the length of the respective plug-in sockets 3 and 4 to define respective connector pin planes 3.2 and 4.2. The plug-in sockets 3 and 4 are connected during plugging to the mating pieces of the mating contact to be connected. These plug-in sockets 3 and 4 are provided with angular conductors 6 and 7. Such plug-in sockets are produced, for example, by stamping from sheet metal and rolling or by turning from suitable metal bars. The angular conductors 6 and 7, which are bent around by 90°, form the soldering ends 6.1 and 7.1 of the signal conductors 6.3 and 7.3, which are led out as free ends. The signal conductors 6.3 and 7.3 extend through lead-through ducts 11, provided in the plate-shaped filter or filter plate 10, and are connected by soldering rings 11.1 to signal layers of non-illustrated capacitors. The capacitors are provided in the filter plate 10 and have counter-electrodes which are led out and connected to a general ground.

The plate-shaped filter 10 which, for instance, is a planar filter that is known per se, lies in a filter holder 12 that receives it, holds it and shields it with its trough-shaped construction. For this purpose, the filter holder 12 is formed of a metal sheet and is connected to a ground of the non-illustrated printed circuit board. The filter holder 12 has openings 12.2 for the lead-throughs of the signal conductors 6,7, corresponding to the lead-throughs of the filter 10, which have a diameter of adequate size to avoid short-circuits to ground with respect to the signal conductors 6,7. Since the collar 5 is also connected to this filter holder 12, a continuous ground connection is ensured without significant inductances.

This filter holder 12 is provided outside the filter with an angled offset 12.1, which is chosen in such a way that its thickness corresponds to that of the plate-shaped filter 10. Therefore, the underside of the plate-shaped filter 10 and the underside of the angled offset 12.1 are in alignment. This angled offset 12.1 is filled with a plastic insert 13, which is essentially form-lockingly inserted in the offset. A centering plate 14 covers an underside of the filter 10 facing the printed circuit board. This centering plate 14 has an elevated, peripheral edge 15 supported against the underside of the plate-shaped filter 10 and is latched with the basic body 2 by latching locations 16 on both end surfaces. This centering plate 14 has the effect of interrupting a heat flow occurring during the soldering-on of the angle-connecting device. An air-filled cavity formed by the elevated, peripheral edge in particular contributes to this effect.

Figure 3:
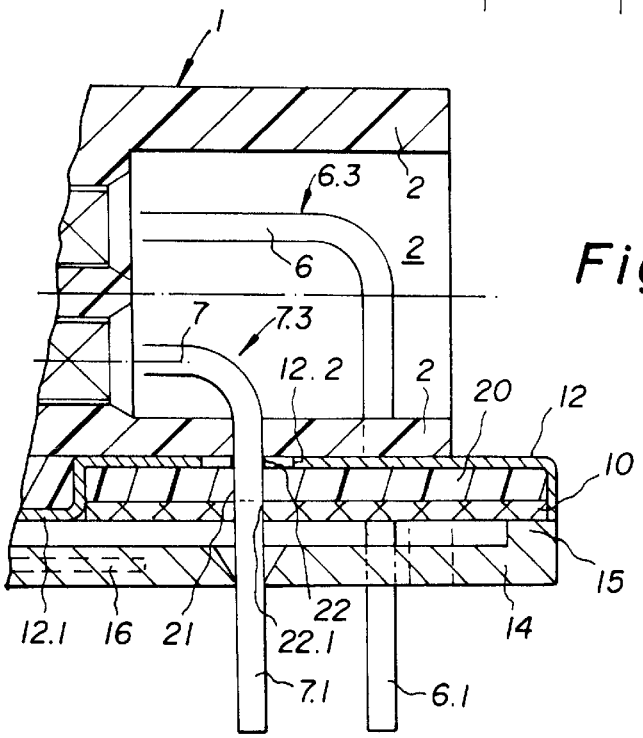
FIG. 3 is a fragmentary, cross-sectional view of an angle-connecting device with a supported planar filter, corresponding to a portion of FIG. 2.

FIG. 3 shows a portion of FIG. 2 illustrating an advantageous application of a filter 10, through which soldering ends 6.1 and 7.1 that are bent-away for connection to a printed circuit board 9 are led. When pressure is applied to the angular conductor 6 and 7 that extend from the angle-connecting device 1, the bent-away soldering ends 6.1 and 7.1 are moved. Therefore, the filter 10 is subjected to great mechanical stress at the locations of the soldering rings 11.1. In order to prevent damage due to such stress, for instance tearing open of the soldering joints, a supporting carrier 20 is provided which has openings 21 in the same pattern as the holes in the filter 10. The supporting carrier 20 is inserted in such a way as to face the bending location. Therefore, the soldering ends 6.1 and 7.1 can be readily led through the filter 10 with the supporting carrier 20. The openings 21 in the supporting carrier 20 enclose the soldering ends 6.1 and 7.1 in such a way that during soldering the solder flows through by capillary action and plays a part in effecting the connection to the filter 10. The soldering ends 6.1, 7.1 or the angular conductors 6, 7 of the signal conductors 6.3 and 7.3 are soldered in the vicinity of the supporting carrier 20 in such a way that solder of each soldering joint 22 takes hold of or includes a respectively corresponding metallized terminal location 22.1 of the planar filter 10. This construction has the advantage of permitting the signal conductors 6.3 and 7.3 to be initially installed in their extended form. Subsequent bending in desired directions no longer stresses the planar filter and shearing forces transmitted to the angle-connecting device 1 during insertion also can no longer mechanically reach the filter 10. This embodiment is particularly suitable in the case of filters 10 which are extremely thin and the substrate of which is ground to size, since the supporting plate can bear with a surface area contact or areally in this case.

The openings 11 in the filter plate 10 are disposed in a configuration. Likewise, the angular conductors 6 and 7 have a configuration. The soldering ends 6.1 and 7.1 of the angular conductors 6 and 7 to be soldered also have a configuration. A supporting carrier 20 supporting the planar filter 10 has lead-through openings 21 in a configuration corresponding to one of the configuration of the lead-through openings 11 in the filter plate 10, the angular conductors 6 and 7, and the soldering ends 6.1 and 7.1.

We claim:

1. A multi-pole angle-connecting device, comprising:

continuous signal conductors each assigned to a pole, said signal conductors being disposed in a configuration and having angular conductors with one soldering end being bent by ninety degrees for soldering to corresponding soldering points of a printed circuit board, another end constructed as connector pins or plug-in sockets in rows to define respective connector pin planes, and a given diameter;

a supporting carrier having openings formed therein corresponding to the configuration of said connector pins, said angular conductors passing through the openings, said openings in said supporting carrier being sized in relation with said angular conductors to create capillary action for distributing molten solder therebetween;

a filter plate having metallized openings formed therein, said angular conductors passing through the openings in said filter plate; said filter plate being disposed adjacent to said supporting carrier in a plane parallel to said connector pin planes, being supported by said supporting carrier, and having a side facing the printed circuit board and an insulating center plate covering said side facing said filter plate, said openings in said filter plate being sized in relation with said angular conductors to create capillary action for distributing molten solder there between;

a metallic filter holder supporting said filter plate, said filter holder being grounded an having openings formed therein for leading through one of said soldering ends of said angular conductors, said openings in said filter holder having diameters larger than the diameters of said soldering ends; and a collar connected to said filter holder.

2. The angle-connecting device according to claim 1, wherein said filter plate has a side facing the printed circuit board, and an insulating centering plate covers said side.

3. The angle-connecting device according to claim 2, wherein said centering plate is a ceramic sheet.

4. The angle-connecting device according to claim 2, wherein said centering plate is a plastic sheet formed of a heat-resistant plastic.

5. The angle-connecting device according to claim 2, wherein said filter plate has a basic body, and said basic body and said centering plate have corresponding latching locations, permitting said centering plate to be inserted into said basic body in a secured manner by latching engagement.

6. The angle-connecting device according to claim 4, wherein said plastic sheet has a fiber reinforcement.

7. The angle-connecting device according to claim 6, wherein said fiber reinforcement is a glass fiber reinforcement.

8. The angle-connecting device according to claim 3, wherein said ceramic sheet of said centering plate is injection-molded.

9. The angle-connecting device according to claim 3, wherein said centering plate has a peripheral, elevated edge facing, bearing against and supporting said filter plate.

10. The angle-connecting device according to claim 1, wherein said filter holder has an angled offset with a plastic insert, and said angled offset faces toward said other end of said angular conductors constructed as connector pins or plug-in sockets.

11. The angle-connecting device according to claim 1, wherein said openings in said filter plate are lead-through openings in a configuration, said angular conductors have a configuration, said soldering ends of said angular conductors to be soldered have a configuration, and a supporting carrier supporting said planar filter has lead-through openings in a configuration corresponding to one of said configurations of said lead-through openings in said filter plate, said angular conductors and said soldering ends.

12. The angle-connecting device according to claim 11, wherein said supporting carrier has end surfaces, and said lead-through openings in said supporting carrier are metallized, at least in the vicinity of one of said end surfaces.

13. The angle-connecting device according to claim 12, wherein said planar filter has metallized terminal locations, and one of said angular conductors and said soldering ends of said angular conductors to be soldered are soldered in the vicinity of said supporting carrier forming soldering joints having solder taking hold of said respectively corresponding metallized terminal locations.

14. A multi-pole angle-connecting device, comprising:

continuous signal conductors each assigned to a pole, said signal conductors being disposed in a row configuration, defining a connector pin plane, and having angular conductors with one soldering end being bent by ninety degrees for soldering to corresponding soldering points of a printed circuit board, another end constructed as connector pins or plug-in sockets, and a given diameter;

a supporting carrier having openings formed therein according to the configuration of said connector pins, said angular conductors passing through the openings, said openings in said supporting carrier being sized in relation with said angular conductors to create capillary action for distributing molten solder therebetween;

a filter plate having metallized openings formed therein, said angular conductors passing through the openings in said filter plate; said filter plate being disposed adjacent to said supporting carrier in a plane rectangular to said bent soldering ends, being supported by said supporting carrier, and having a side facing the printed circuit board and an insulating center plate covering said side facing said filter plate, said openings in said filter plate being sized in relation with said angular conductors to create capillary action for distributing molten solder therebetween;

a metallic filter holder supporting said filter plate, said filter holder being grounded and having openings formed therein, each for leading through one of said soldering ends of said angular conductors, said openings in said filter holder having diameters larger than the diameters of said soldering ends; and a collar connected to said filter holder.

15. The multi-pole angle connecting device according to claim 14, wherein said filter holder has an angled offset with a plastic insert, and said angled offset faces toward said other end of said angular conductors, said other end being constructed as connector pins or plug-in sockets.

16. The multi-pole angle connecting device according to claim 14, wherein said openings in said filter plate are lead-through openings disposed according to the configuration.

17. The multi-pole angle connecting device according to claim 16, wherein said supporting carrier has end surfaces and said lead-through opening in said supporting carrier are metallized at least in the vicinity of said send surfaces.

18. The multi-pole angle connecting device according to claim 17, wherein said filter plate has metallized terminal locations and said soldering ends of said angular conductors to be solders are soldered in the vicinity of said supporting carrier forming soldering joints having solder taking holds of said respectively corresponding metallized terminal locations.

19. The multi-pole angle connecting device according to claim 17, including solder connecting said soldering ends to the corresponding metallized terminal location of said filter plate said solder having been distributed throughout said lead-through hole by capillary action.

20. The multi-pole angle connecting device according to claim 14, wherein said centering plate is a ceramic sheet.

21. The multi-pole angle connecting device according to claim 20, wherein said centering plate is injection molded.

22. The multi-pole angle connecting device according to claim 17, wherein said centering plate is a heat-resistant and insulating plastic sheet.

23. The multi-pole angle connecting device according to claim 22, including a reinforcement in said centering plate.

24. The multi-pole angle connecting device according to claim 23, wherein said reinforcement is formed of fiberglass.

25. The multi-pole angle connecting device according to claim 17, wherein:

said centering body has latching locations; and said filter body includes a basic body having latches for securing said latching locations.

26. The multi-pole angle connecting device according to claim 14, wherein said filter plate is to be soldered onto the printed circuit board.

* * * * *